US009375036B2

(12) United States Patent
Chorne

(10) Patent No.: US 9,375,036 B2
(45) Date of Patent: Jun. 28, 2016

(54) ZIPPER ATTACHED SPORTS GLOVE WITH FLY COVER PROTECTION

(71) Applicants: Robert Chorne, Freeport, NY (US); DJPZ HOLDINGS LTD., Freeport, NY (US)

(72) Inventor: Robert Chorne, Freeport, NY (US)

( * ) Notice: Subject to any disclaimer, the term of this patent is extended or adjusted under 35 U.S.C. 154(b) by 0 days.

(21) Appl. No.: 14/795,488

(22) Filed: Jul. 9, 2015

(65) Prior Publication Data

US 2015/0305416 A1 Oct. 29, 2015

Related U.S. Application Data

(63) Continuation-in-part of application No. 14/337,565, filed on Jul. 22, 2014, which is a continuation-in-part of application No. 13/689,349, filed on Nov. 29, 2012, now abandoned.

(30) Foreign Application Priority Data

Nov. 26, 2013 (WO) ..... PCT/US2013/07202

(51) Int. Cl.

| | |
|---|---|
| ***A63B 71/14*** | (2006.01) |
| ***A41D 13/08*** | (2006.01) |
| *A41D 19/015* | (2006.01) |

(52) U.S. Cl.

CPC ..... *A41D 13/082* (2013.01); *A41D 13/084* (2013.01); *A41D 13/087* (2013.01); *A63B 71/143* (2013.01); *A41D 13/085* (2013.01); *A41D 19/01523* (2013.01); *A63B 2102/14* (2015.10); *A63B 2102/24* (2015.10); *A63B 2209/10* (2013.01)

(58) Field of Classification Search

CPC ... A41D 13/08; A41D 13/081; A63B 71/143; A63B 71/14

See application file for complete search history.

(56) References Cited

U.S. PATENT DOCUMENTS

| | | | | | |
|---|---|---|---|---|---|
| 2,451,837 | A * | 10/1948 | La Londe | A41D 19/01 | 2/158 |
| 4,773,100 | A * | 9/1988 | Kuo | A41D 3/06 | 2/159 |
| 5,020,161 | A * | 6/1991 | Lewis, Jr. | A41D 19/01529 | 2/159 |
| 5,329,639 | A * | 7/1994 | Aoki | A63B 71/143 | 2/16 |
| 5,699,632 | A * | 12/1997 | Stout | A41D 19/01 | 2/158 |
| 6,338,163 | B1 * | 1/2002 | Markson | A41D 19/0017 | 2/161.6 |
| 2004/0064870 | A1 * | 4/2004 | Gold | A41D 19/01 | 2/158 |
| 2011/0126342 | A1 * | 6/2011 | Bautista | A63B 71/143 | 2/161.1 |
| 2014/0359916 | A1 * | 12/2014 | Baunach | A41D 19/0017 | 2/163 |

* cited by examiner

*Primary Examiner* — Shaun R Hurley
*Assistant Examiner* — Andrew W Sutton
(74) *Attorney, Agent, or Firm* — Alfred M. Walker

(57) ABSTRACT

A method of protecting a participant user, participant player, players, referee, official, coach or spectator from skin contact with an exposed connector by isolating the connector of a sports glove, which includes a front palm portion having finger stalls for insertion of fingers therein, and a rear back joinable portion which is attachable to said front palm portion by a connector, such as a zipper. The method includes the step of removably covering the zipper connector with a friction fit fly cover having an attachment end and a free end, wherein further lifting of the free end of the fly cover exposes the zipper for participant user engagement therewith. The fly cover prevents any exposure of the metallic or plastic connector.

24 Claims, 11 Drawing Sheets

ZIPPER ATTACHED SPORTS GLOVE WITH FLY COVER PROTECTION

RELATED APPLICATIONS

This application is a continuation-in-part of application Ser. No. 14/337,565, filed Jul. 22, 2014, which '565 application is a divisional and continuation-in-part of U.S. patent application Ser. No. 13/689,349, filed on Nov. 29, 2012, and claims priority in part under 35 U.S.C. §120 therefrom. This application also claims priority from Patent Cooperation Treaty patent application PCT/US2013/072021, filed Nov. 26, 2013, and claims priority in part therefrom. These applications are incorporated by reference herein.

FIELD OF THE INVENTION

The present invention relates to a protective glove and its palm-fingers unit for hockey, lacrosse and other similar sports gloves. Specifically the invention relates to hockey, lacrosse and sports gloves in which the palm-finger unit for holding the shaft, stick, etc., can be easily removed and replaced quickly and easily while having a protective fly cover to grasp over and closely cover a zipper attachment when it is installed in the glove.

BACKGROUND OF THE INVENTION

Prior Art

During hockey and lacrosse when a player uses a pair of gloves for a prolonged period of time, the palm-finger area of the glove gets worn, wet, and reduces the players ability to hold the shaft, stick etc. with a good sensitivity within the player's hand allowing a comfortable feeling between shaft, stick and the player fingers and palm.

The players require this sensitivity to maintain skillful stick or ball handling which is essential in hockey and lacrosse. This all must be in a glove that is comfortable and not have exposed elements such as a zipper when the glove is being used.

In hockey and lacrosse gloves, the portion on the back of the glove is usually protected with internal padding and is less susceptible to damage from the elements such as water, ice, grass and wear during conventional use. The front or palm-finger unit of the glove exhibits wear to a much greater extent during use due to constant engagement with the shaft, stick etc. Consequently, the palm-finger area of these hockey and lacrosse gloves is more likely to abrade and tear, or get brittle than the back of the glove.

Therefore, the palm-finger area of a glove is generally the determining factor of the durability, life and or legality of wearing according to the rules of the hockey and lacrosse gloves and the like.

U.S. Pat. No. 5,329,639 to Aoki discloses an ice hockey glove which addresses some of these issues. The ice hockey glove in Aoki patent discloses a hockey glove with a removable palm area at peripheral edges of the glove. The attaching means is a zipper installed at peripheral edges of the ice hockey gloves front and back member. Having an a zipper at peripheral edges as shown suffers in the shape, and feel in the finger area, which becomes abnormal and the internal area which touches the fingers is bothersome—not comfortable. Another major problem is that it leaves exposure of the attachment zipper to outside elements. This leads to exposure from other sticks, shafts during play leading to quick failure. Another major failing of the Aoki patent is that it leaves exposure of the attachment zipper to other players which are undesirable in these sports. Additionally, the attachment of the back padding to the exterior side of the glove may lead to padding failure. This makes the back area less durable and susceptible to outside elements. This would also fail to conform to the configuration of the users hand as it gets damaged or comes off and possibly failing to adequately protect the users. Additionally the wrist closure mechanism suffers as it takes too long to use and has too many pieces that must be engaged before using. Additionally, if the player is required to (must) put their hand in the glove in order to close the cuff area, makes it more difficult and less desirable to operate and function. The time frame is also increased which is less desirable. In this case, one only has the ability to close the mechanisms with the opposite hand instead of the dexterity of using two hands. This suffers in function. It is also more costly to produce.

U.S. Pat. No. 2,451,837 of Lalonde describes a sportsman's mitten zipper with a loose flap covering a linear zipper. As shown in the Lalonde '837 patent, the drawings show the entire cover either open or closed as it is not held by friction. So a portion of the cover on Lalonde could not be closed. Lalonde's fly cover has to be able to be kept open at certain times in use. For example, Lalonde states explicitly at column 3, lines 20-28 as follows: "It is therefore to be realized that where the user occasionally requires use of the fingers in the grasping or manipulation of an element, such as a fishing real, the trigger of a gun or other element or apparatus, the mitten is worn with the slot open to enable the fingers to be readily projected through the slot for a required use and then withdrawn from the slot until again required to e projected." (emphasis added).

Further in contrast, Lalonde's zipper, while covered by a flap, the flap of Lalonde must be manually pulled down and away from the linear zipper, when Lalonde's mitten is in use, thereby exposing the zipper during use, which is the opposite of the present invention, whereby Applicant's zipper is completely covered by the fly cover during use in a sports game.

For example, Lalonde at column 4, lines 7-10 states "the flap is thus readily turned either to cover or uncover the zipper", stating therefore that it must be pulled down to expose the zipper (emphasis added).

If Lalonde's flap were applied to Applicant's sport's glove, this theoretical combination of Lalonde and Aoki would create an unsafe condition (in Applicant's sports glove), of Lalonde's loose cantilevered fabric, exposing the skin of the participant to the zipper of Aoki.

U.S. Pat. No. 3,605,117 to Latina discloses an ice hockey glove which addresses some of the issues. The hockey glove of the Latina patent discloses a hand receiver portion or an inner glove which is attached to a padded back portion at the ends of the finger stalls and the outer sides of the palm area, but otherwise remains detached from the inner glove. The inner glove is coupled to the padding through lacing. Consequently, when the face of the inner glove wears out, the lacings need to be withdrawn and a new inner glove installed, thereby allowing reuse the back padding. The Latina patent suffers from the disadvantage that it does not allow for quick replacement of the inner glove. Replacing the entire glove of the Latina patent is a time consuming procedure requiring the user to remove and replace all of the laces in the hockey glove. Additionally, the replacement of the entire inner glove portion in the Latina patent is not most efficient procedure since only the palm portion of the glove is generally damaged. Additionally, the attachment of the back padding to the glove at only distinct points may lead to the padding failing to conform to the configuration of the users hand and possibly failing to adequately protect the users in certain positions.

OBJECTS OF THE INVENTION

An object in the present invention is to overcome the aforementioned drawbacks of the prior art.

Additionally, an object of the present invention is to provide hockey, lacrosse players and the like, with a desirable, usable, quick efficient and economical glove with a palm-finger unit replacement that also has protection for the attachment means and protects the players from contact with the attachment means.

Other objects which become apparent from the following description of the present invention.

SUMMARY OF THE INVENTION

In keeping with these objects and others which may become apparent, the present invention is a new improved version of a two piece, connector joined sports glove, such as hockey, lacrosse and other sports gloves. The sports glove of the present invention features a joining connector, such as a zipper, set of snaps or other suitable attachment, covered by a fly cover. The zipper attaches the front palm with fingers portion to the glove portion. The fly cover protects the zipper attachment from damage caused by impact from the sports mentioned and protects the players in these sports from exposed zippers.

The present invention also describes a method of joining the front and back of a sports glove (hockey, lacrosse, cricket, baseball and the like), utilizing a zipper attached to the front and back portions. whereby the zipper is engaged to form at least the upper finger stalls and the palm of the sports glove. The zipper is covered with a panel or fly cover thereby protecting the user, participant player(s) from skin contact with an exposed zipper. The method further includes joining the front and back of the sports glove (hockey, lacrosse, cricket and the like), utilizing a connector attached to the front and back portions. whereby the connector is engaged to form at least the upper finger stalls and the palm of the sports glove. To protect the skin and/or face of both opposing participant players, and the participant himself or herself, this connector is covered with a panel or fly cover thereby protecting the user, participant player(s) from skin contact with an exposed connector.

This development also leads to a better feeling glove with more comfort, a normal look and a non exposed zipper. The fly cover can be the same material as the front palm-finger area or it can be different material. It can also be a combination of materials. It can be made of any suitable material used to make gloves or a combination of any suitable material or materials.

In the preferred embodiment the fly cover can match the finger material or it can be different. The fly cover can be part of the front palm-finger portion in the sports glove such as hockey and lacrosse and the like. The fly cover can go from the glove portion (side) to the front palm side to cover the zipper. The fly cover can be a combination of the glove side and the front palm-finger side portions. The fly cover can be from the front palm side of the glove portion (side) to the glove portion. The percentage of each can be any percentage that can be feasible if one uses a combination of glove and front palm portions to form the fly cover.

The fly cover can be different directions on different parts of the gloves if desired. The fly can overlap the nearest material that it is trying to meet. The fly can also be just shy of meeting the material it is trying to meet.

The preferred embodiment would have the fly-cover cover the zipper as much as possible. Other embodiments may have less than the full coverage; however, anything covering at least 50 percent of the zipper would be preferable.

The fly cover can go from left to right or right to left or any combination of these. The fly cover can go up to down or down to up or any combination of these. The fly cover can be any direction or a combination of directions. The fly cover can be any suitable material or a combination of suitable materials.

The zipper can be made of any suitable material or materials. Examples include plastic, nylon, synthetic, polymer materials, metal, ferrous or non ferrous material, carbon fiber or any suitable material or combination of materials. The fly can be made from any suitable material or a combination of materials. The fly can be made from one piece of material or it can be made of multiple pieces.

The fly cover material can be fabric type material, either synthetic or natural, such as leather, synthetic leather, suede, synthetic suede, Nash, micro fiber type material, VELCRO® hook and loop fastener, any natural or synthetic material or combination of materials and fibers that can be used in this industry for gloves. The fly cover can be any color or combination of colors.

The zipper can be made from any suitable material or combination of materials. The fly can be cut, formed, molded, cast, forged, pressed, sewn or use any known manufacturing method or methods to make it.

The zipper can be made from any suitable material or combination of materials. The zipper can be sewn, molded, pressed, cast, forged, formed, cut or be made by any known manufacturing method or combination of methods or manufacturing techniques. The attachment of the zipper and fly cover can be sewn, glued, bonded or use any suitable bonding technique or any combination of techniques.

The zipper can be installed on the front palm unit in any feasible position-possible position. The preferred embodiment would have the zipper teeth at least slightly away from the back of the front palm units—finger receptacle edges.

The zipper attachment on the glove side can be installed toward the middle of the fingers, toward the back of the fingers or toward the front of the fingers or any feasible position that will allow the operation and comfort for the fingers. On the preferred embodiment, the continuation of the zipper toward the sides of the hand and cuff would be toward the outer portion of the glove unit. The preferred embodiment would have some material between the edge of the finger unit and the zipper.

The connector (i.e. zipper) is provided in a closed position during use of the glove during game play, and that the connector is continuously covered by a fly cover, which clasps and extends closely over the connector, during use of the glove during game play, whereby said connector is not exposed to the skin of a sports game participant wearing the glove or to the skin of a sports game participant not wearing said glove.

The fly cover is sewn in place to the front palm portion and/or said back glove portion, and the fly cover clasps and extend closely over the closed zipper during use of the glove during game play, without any attachment other than friction.

The zipper is in a position and protected so that it doesn't interfere and that the zipper and fly cover extend around the undulating periphery of the joined front and back portions of the hockey glove. Therefore, the fly cover clasps and extends closely over the zipper. There is no gap that would interfere with the protection of the zipper under the fly cover.

Without the friction fit of the fly cover, the whole cover would fall once peeled away during an active contact sport.

The sports glove, used in a sports event by a sport participant holding an item during game play, includes:

a) a front palm portion having finger stalls for insertion of fingers therein;

b) a back glove portion attachable to said front palm portion by a connector, in a closed position during use of the glove during game play; and c) said connector continuously covered by a fly cover clasping and extending closely over said connector during use of the glove during game play;

d) wherein said closed connector and said fly cover extend in a continuous peripheral non-linear serpentine line of varying radii around each finger stall and thumb stall and side of hand leading toward the cuff on the glove portion and each finger stall and thumb stall and side of hand leading to said cuff on said front palm portion during use of the glove during game play;

e) whereby said connector is not exposed to the skin of a sports game participant wearing said glove or to the skin of a sports game participant not wearing said glove f) preferably, optionally said front palm portion having a pivotable cuff portion and said rear back joinable portion having a partially fixed, flexible cuff portion having an open top edge with a fastener strip therein; and, g) preferably and optionally, the front cuff portion being tightened against the fly cover with a distal fastener strip closely grabbing around the front and rear cuff portions over a beginning of the fly cover near a zipper tab clasp of the zipper, wherein the fastener strip extends into a top edge between the partially fixed, flexible rear cuff and the rear of the glove.

In an alternate embodiment, the sports glove further includes closable wrist cuff including a back portion attached to the back glove portion of the sports glove, and a pivotable portion with a fastener strip with fastener material, such as VELCRO® hook and loop fasteners, wherein the back portion and the front palm portion are attached together by the zipper being on the front palm portion and the back portion, the zipper being covered by the fly cover, and the pivotable flap and fastener strip exert pressure on the zipper handle portion of the fly cover to back portion and front palm portion are attached together by zipper being on the front palm portion and the back portion, with the zipper being covered by a combination of front to back and back to front fly covers clasping and extending closely over the zipper, to prevent exposure of the zipper to the skin of the players playing a game, such as hockey.

The combination of front to back and back to front fly covers clasp and extend closely over the zipper and optionally overlap each other.

The long fastener strip that wraps around the back of the glove creates a difference to tighten the fly cover. For example, the strip secures the front cuff, and in so doing insures that the fly is wrapped over the zipper tab located on the outside of the palm, preventing any exposure of this metallic or plastic zipper tab piece.

Optionally the fly cover can have a thin peripheral edge of a friction attachment, such as a hook and loop VELCRO® fastener, which is joinable to a reciprocal hook and loop VELCRO® fastener located on the glove surface immediately adjacent to the zipper portion, so that the friction attachment overlays and extends beyond the zipper. Other friction attachments can be a plurality of discontinuous strips, or strips of reusable self adhesive material, or pressure locks, such as ZIPLOC® fasteners.

BRIEF DESCRIPTION OF THE DRAWINGS

The present invention can best be understood in connection with the accompanying drawings. It is noted that the invention is not limited to the precise embodiments shown in drawings, in which.

Figure 1:
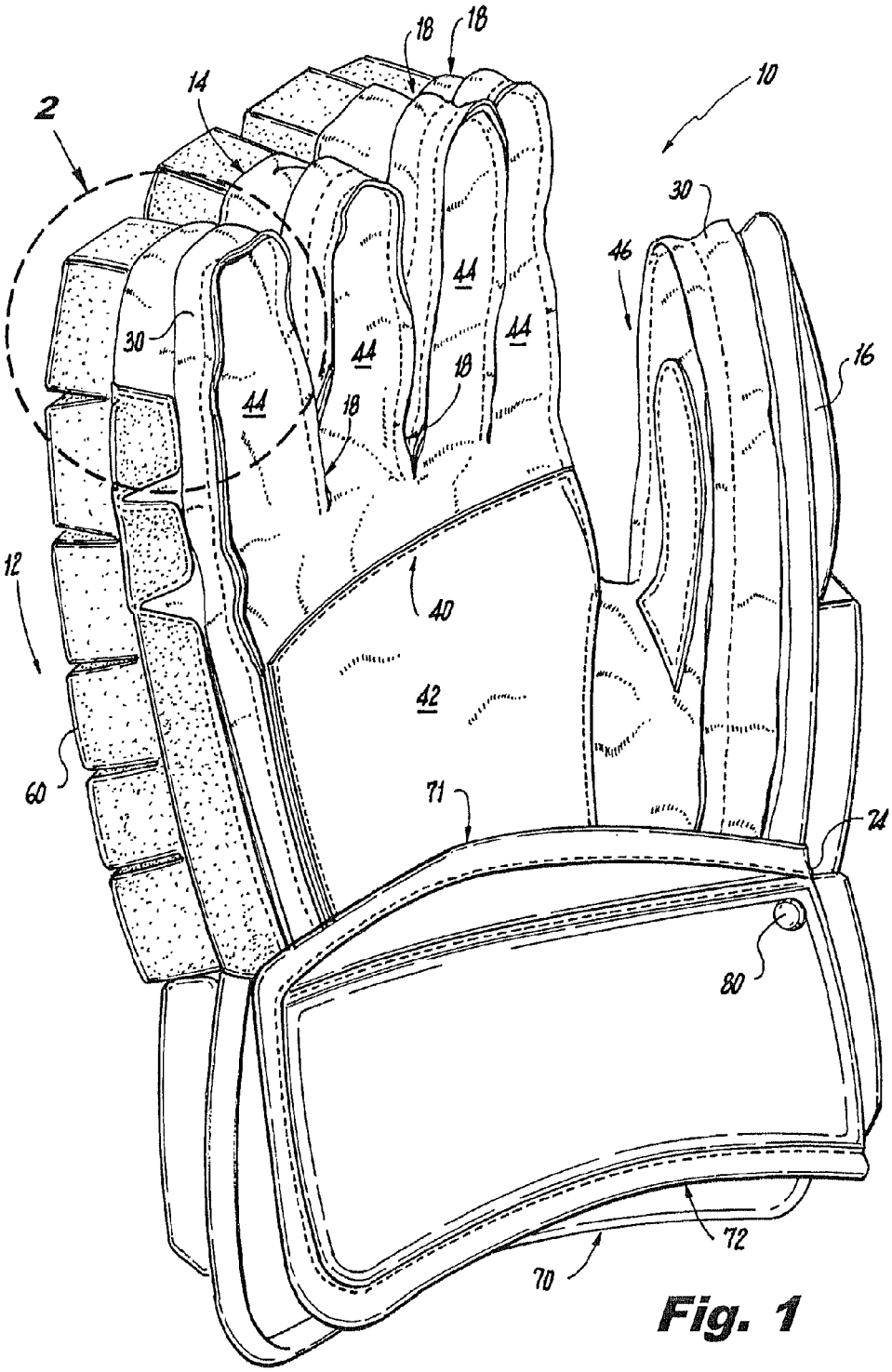
FIG. 1 is a front perspective view of the zipper attached sports glove with fly cover protection of the present invention.

The stippling in the drawings represents texture.

DETAILED DESCRIPTION OF THE INVENTION

The present invention provides a hockey glove, lacrosse glove, sports gloves, with an easily replaceable front palm-finger unit while protecting the attachment means.

The hockey glove 10 includes a back member 12 having a body portion 14, a thumb portion 16 and a plurality of finger portions 18. Padding members 60 are permanently internally encapsulated within the glove to protect the fingers, thumb, back and side portions of the glove and the cuff area 70, thereby protecting the user's hand. A plurality of internal changeable front member units 40 is provided with each front member including a front palm portion, a thumb portion and a plurality of finger portions. The number of finger portions of the front member unit 40 corresponds to the number of finger portions in a corresponding back member in the preferred embodiment. There can also be a different number of finger elements or socket or receptacle from one to five, however, the preferred would match as stated.

An attaching means removably couples one of the front members to the back member.

The coupled front and back members cooperate to form a hand receiving portion which includes a palm, thumb stall and a plurality of finger stalls.

The hockey and lacrosse gloves and sports gloves of the present invention include the glove to the users' hand and wrist area. The protective element for the wrist area is known as the cuff 70 and 72 in FIG. 1. A wrist cuff closure mechanism for securely and easily fastening is provided.

The wrist cuff includes a back portion 72 attached to the glove side and the front portion 70 which is attached to it as a continuation from the glove portion 72. The wrist cuff is not fully sewn to form a continuously closed cuff around its perimeter. There is an open portion, so the cuff is not permanently closed. It allows the cuff to open and close. The two or more parts of the cuff have hinged action from the sewing or attaching the parts together while not permanently attaching the opposite side to the gloves back portion. The closure mechanism may include VELCRO® hook and loop type fasteners, and snaps or any other workable attachment means. The preferred closure has a VELCRO® hook and loop type fastener on the base of the palm at the wrist area and opposite on the cuff side 71. These two areas coincide to form the attachment at these locations across the lower region of the palm area that meets it. The cuff only requires one snap 80, which securely fastens the cuff together so it can't open easily in play. The snap is at the end or toward the end of the open portion, two parts that need to be joined to close the cuff. The snap has a male portion and a female portion, the male and female portion are positioned to meet from the two portions that are needed to close the cuff area. FIG. 1 represents the area for the snap at reference numeral pairs 80, 74 or 80, 72 or a location in this area as described.

Detailed Description of the Preferred Embodiments

The hockey or lacrosse glove 10 of the present invention includes a back member 12, shown in FIG. 1, which covers the back of the user's hand. The back member includes a body portion 14, a thumb portion 16 and four finger portions 18, although it should be noted that the glove may be formed with less than four finger portions 18.

The zipper 20 connects the front palm portion 42 of the sports glove 10 with the rear portion 12 of the sports glove 10. The zipper 20 is covered by a fly cover 30 wherein the zipper 20 and the fly cover 30 extend in a continuous peripheral non-linear serpentine line of varying radii around each finger stall 44, thumb stall 46 and side of hand leading toward the cuff 70 on the rear glove portion and each finger stall 44 and thumb stall 46 and side of hand leading to the cuff 72 on the palm portion 42.

Padding 60 is encapsulated between the body portion 14 and back portion 12 to protect the exterior side of the back member 12 and it substantially covers the exterior portion of the back member 12 to protect the user's hand. The padding 60 may be in the form of foam inserts into the areas needed to be protected such as the fingers and back of hand and side of hand and cuff area. The padding may also be in the form of a plurality of rolls, some of which extend across the back of the hand, generally on the back of the body portion 14. Other of the rolls may be positioned longitudinally along the back area of the finger portions 18. Similarly, another padding roll or insert may be provided which corresponds to the shape of the thumb portion 16. Thumb portion 16 may also have a plastic insert along with foam padding adding further protecting the thumb. Additionally the padding may be tapered and or have any shape desired.

Figure 5:
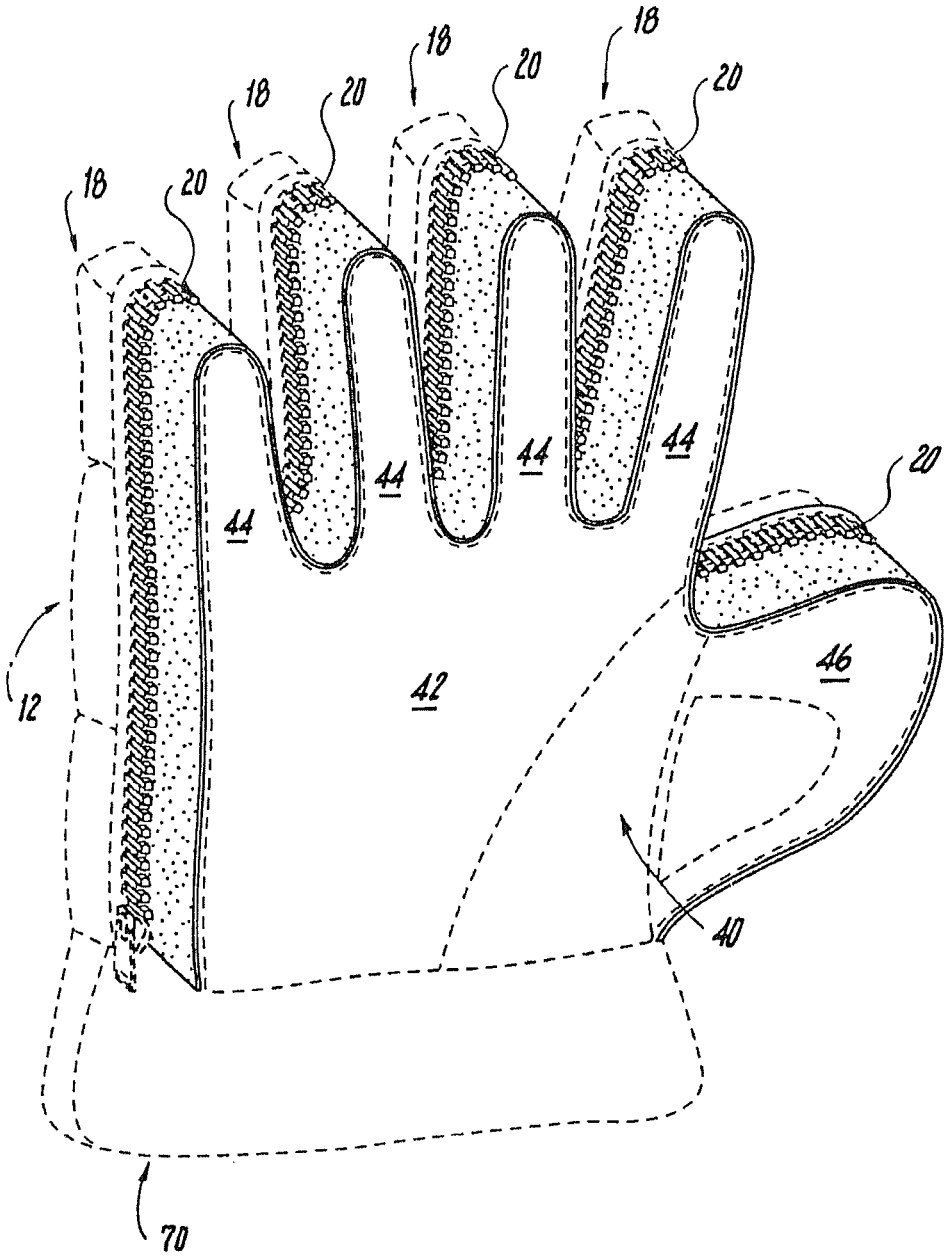
FIG. 5 is a front perspective of another embodiment for one hand of a pair of a zipper-attached front palm units according to the present invention.

The removable front palm unit 40, shown in FIG. 5, covers the front portion of the players' hand. A plurality of front finger members 44 may be provided for use with a single back member 12. Each removable front palm units 40 includes a palm portion 42, a thumb portion 46 and four finger portions 44. The thumb portion is usually stitched to the remainder of the front palm portion. Fewer finger members 44 may be formed limited only in that the number of finger portions 44 of the front palm unit 40 is intended to correspond with the number of finger members 18 of the back member 12. The front palm unit can be any thickness desired or any material desired or any combinations of material desired. It is contemplated that a plurality of front palm units with varying thicknesses and or materials can be attached to the same back member 12. However, it is preferred that the front palm unit 40 have a thickness that allows greater feel by the player. This can be achieved using the desired material and thickness for the particular material.

The size and material provide an effective hockey and lacrosse glove which maintains the appropriate flexibility and control for the player. Front palm unit may terminate at the very bottom of the wrist area. VELCRO® hook and loop type fastener or another closure material or device can be stitched to the base of the front palm unit to aid in the cuff closure. As shown in the accompanying drawings, the back member 12 and front palm unit 40 are attached together by a closure, such as a zipper 20 on the front palm unit and 22 on the glove unit, covered by fly 30 from front to back or fly 32 from back to front or fly 34 which forms in the middle to form a hand receiver portion which includes a thumb stall and a plurality of finger stalls. The zipper and fly extend around each finger and thumb unit and side of hand leading toward the cuff on the glove side and each finger and thumb and side of hand leading to the cuff on the palm side. Additionally the zipper and fly cover extend along the thumb 16 on the glove portion and 46 on the palm unit and finger portions 18 on the glove portion and 44 of the front palm unit, thereby connecting the front palm unit to the back member 14 forming a hand receiving unit. The zipper is preferably a thin, narrow, soft zipper with a lock, thereby allowing the zipper 20 on the front palm unit and 22 on the glove unit to effectively operate in the space provided between the finger walls and also the fly cover.

The hockey and lacrosse glove or sports glove 10 of the present invention includes a wrist closure mechanism for securely fastening the glove at the users' wrist. The wrist closure mechanism includes a first flap 70 attached to one side of the of the body portion 14. A hook and loop type fastener such as VELCRO®, is attached to the interior of flap 70 at or near the inside horizontal area at 71. Additionally a snap 80 or other closure devise is attached to the flap 70. The female portion of the snap can be on the inside of this flap.

A second flap 72 can have the male portion which coincides with the snap on flap 70. The preferred embodiment would have the male portion on the glove side next to the base of the zipper 74 attachment on the side of the glove. Near this area on the glove side can have the male portion of the snap. This may also be reversed to allow 72 or 74 to have the male side of the snap and the inside of flap 70 have the female portion to receive. The preferred embodiment would have the female portion of the snap on the 70 flap and the male portion of the snap on position 74. The exterior side of the front palm unit base would also have VELCRO® hook and loop type fastener which coincides to the shape and size on the first flap at 71 for closure purpose. The snap or other closure devise is for a secure closure.

In operation the wrist closure operates as follows:

With or without the players hand in the glove 10, the first flap 70 secures the VELCRO® hook and loop fastener on the inside of flap 70 coinciding with to the palm units VELCRO® hook and loop fastener type of attachment at coinciding areas or points as it closes and the snap 80 locks the cuff unit secure on position 74.

The zipper 20 on the palm unit and 22 on the glove portion is protected by the fly cover 30 which goes from front to back, or 32 which goes from back to front or 34 which goes in both direction toward the middle, allows for quick and easy replacement of the front palm unit 40. The fly cover can be a combination of any direction from the palm unit or the glove portion or be any combination of the two. It can even be different ways of covering the zipper in different sections of the glove or palm unit. The zipper is in a position and protected by the fly cover so that it does not interfere with the operation and use of the hockey or lacrosse glove or other sports glove 10. The zipper and fly cover extend around the portions of the players hand and fingers in which the hand fits into. The present invention allows a single back member 12 and a plurality of front palm units 40, thereby extending the life and usefulness and function of the glove 10.

Another embodiment may have a gap between the base of the palm unit and cuff area. On this glove the cuff will not overlap the palm unit. There can be a gap between the cuff and the palm unit. The tab on the bottom of the zipper on each side may be covered by a piece of material coming off the glove or as part of the replaceable palm or a combination of both.

This embodiment allows more freedom for the wrist to maneuver while having a replaceable palm unit.

Figure 2:
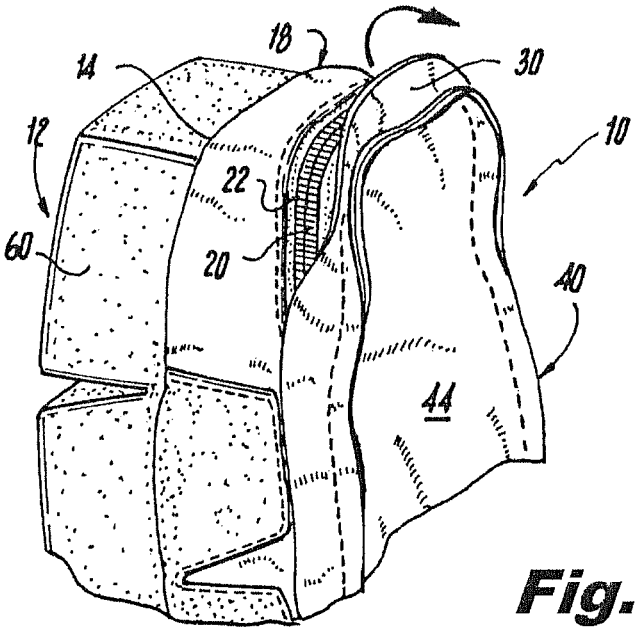
FIG. 2 is a close up detailed view thereof.
Figure 3:
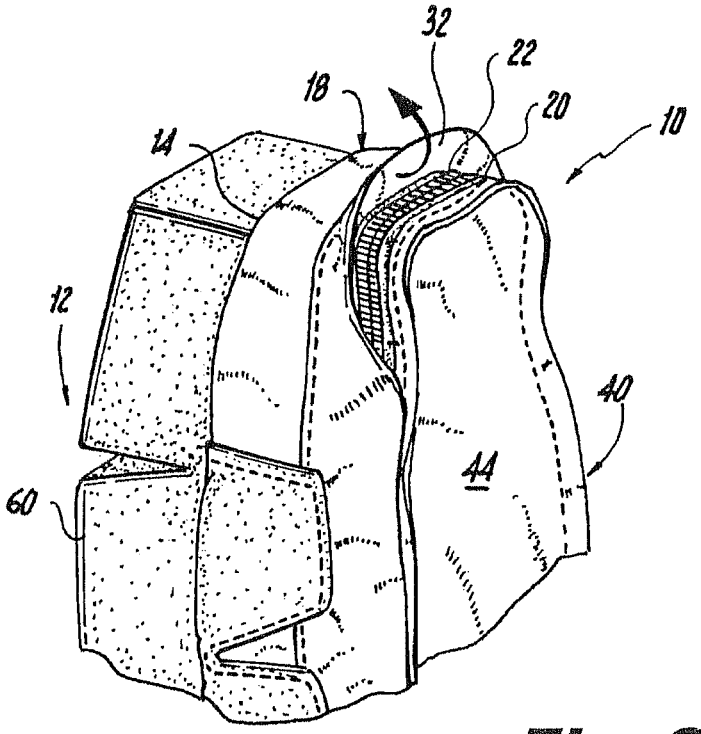
FIG. 3 is a close up detailed view of an alternative embodiment thereof.
Figure 4:
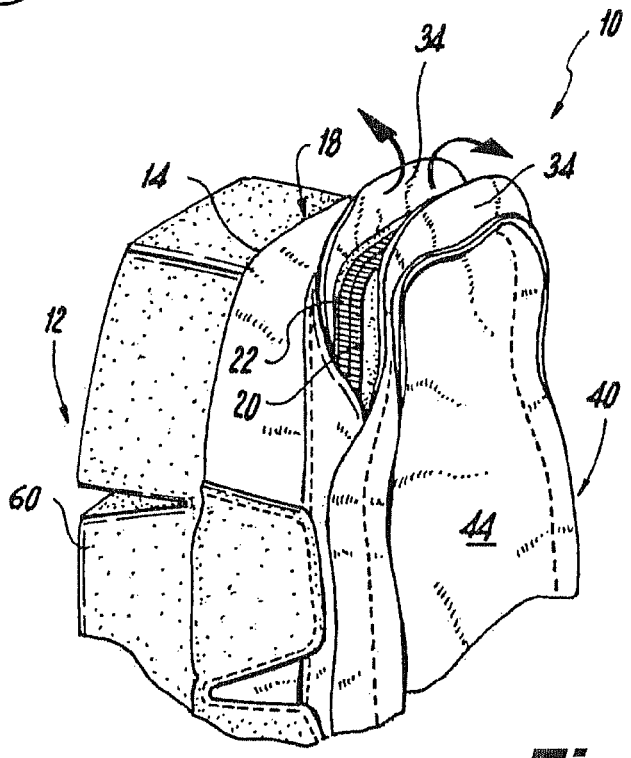
FIG. 4 is a detailed view of a further alternative embodiment thereof.

Another embodiment is a replaceable front palm unit 40 which has a zipper attachment 20 as shown in FIG. 2 and a fly cover 30, 32, 34 as shown in FIGS. 2, 3 and 4. The fly cover may be only a portion of a fly cover to cover the zipper attachment or cover a portion of the zipper attachment on the front palm unit. The fly cover may be able to cover the majority or even most of the zipper if not all of the zipper attachment on the front palm unit. Whatever percentage is needed or works best would be alright as the desired results are achieved. The front palm unit has a palm section, a thumb section and a plurality of finger portions which will coincide with the glove portion to form a hand receiving unit. The base of the front palm unit may have VELCRO® hook and loop type fastener to aid in the cuff closure when the palm of the glove is in the glove unit. There may be any number of finger portions or hand shapes—make up to any desired form to form a hand receiving unit. The fly cover may be any portion of the total fly cover and can vary in thickness and shape or size or length if desired or be consistent if desired or any combination of percentages within the replaceable palm unit.

On the preferred embodiment, the snap would be on the cuff flap 70 with the female portion being exposed on the inside of the cuff flap toward the end of the flap as shown on FIG. 1. The base of the side of the glove side opposite the cuff flap would have the male portion of the snap 74 as shown in FIG. 1. This would be next to the palm units' zipper attachment's zipper. The snap could then be closed and secured from the wrist cuff flap to the glove side.

FIG. 2 is a detailed close up view of the glove portion containing a portion of the zipper 20 from the palm unit and 22 from the glove unit. Fly cover 30 on the front palm unit covers both elements of the zipper attachments from the front palm unit and the glove unit. The fly cover is attached to the front palm unit and is made with material that is sewn and part of the front palm unit, thereby protecting the zipper attachment. The direction of the fly cover is from front palm unit towards glove unit. FIG. 2 shows a partially peeled away view. The part of the fly cover 30 that is not peeled away covers the zipper 20, grasping and closely extending over the zipper 20 without any attachment other than friction. The zipper 20 is protected by the fly cover 30, which clasps by friction and closely extends over the zipper 20. Without the friction fit of the fly cover 30 over the zipper 20, the fly cover 30 would fall away during vigorous use of a contact sports game, such as ice hockey.

FIG. 3 is a close up view of an alternative embodiment. On this embodiment the fly cover 32 is part of the glove unit. The zipper 20 from the front palm unit attaches to the zipper 22 on the glove unit the fly cover 32 covers the zipper attachment as shown and describes with material that is attached to the glove unit. This protects the zipper attachment.

Figure 3A:
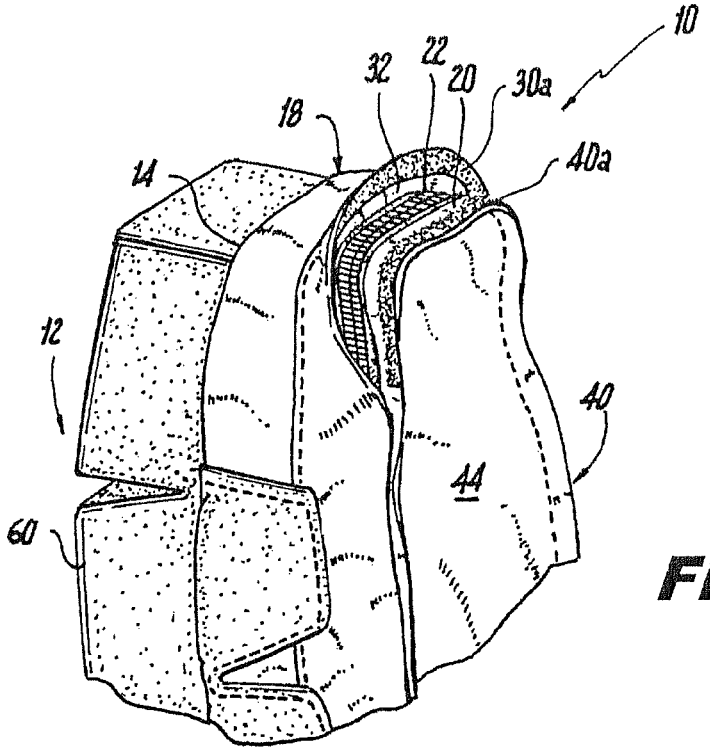
FIG. 3A is a close up detailed view of another alternate embodiment thereof.

FIG. 3A is a close up view of a further alternate embodiment where the fly cover 32 can have a thin peripheral edge of a friction attachment, such as an elongated strip 30*a* of a hook and loop VELCRO® fastener material, which is joinable to a reciprocal strip 40*a* of hook and loop VELCRO® fastener material located on the glove surface immediately adjacent to the zipper 20 portion, so that the friction attachment 30*a*, 40*a* overlays and extends beyond the zipper 20.

FIG. 4 is a close up view of a further embodiment. This shows the zipper 20 from the palm unit joins zipper 22 from the glove unit. The fly cover 34 has material from both the palm unit and the glove unit. The fly cover covers the zipper attachment and protects the zipper.

Another embodiment can have any combination of the above embodiments where the material used for the fly cover can come from either or both the front palm unit or glove unit or both. There can be another embodiment that has varying areas around or near the zipper portion were the material can come from one side or the other or both.

FIG. 5 is a front perspective of a zipper attached front palm unit 40 according to the present invention. This view shows the majority of the zipper element 20 as it goes from the side of the hand closest to the cuff 70, around the plurality of finger elements 44 and around the thumb area 46 on the front palm unit 42.

Figure 6:
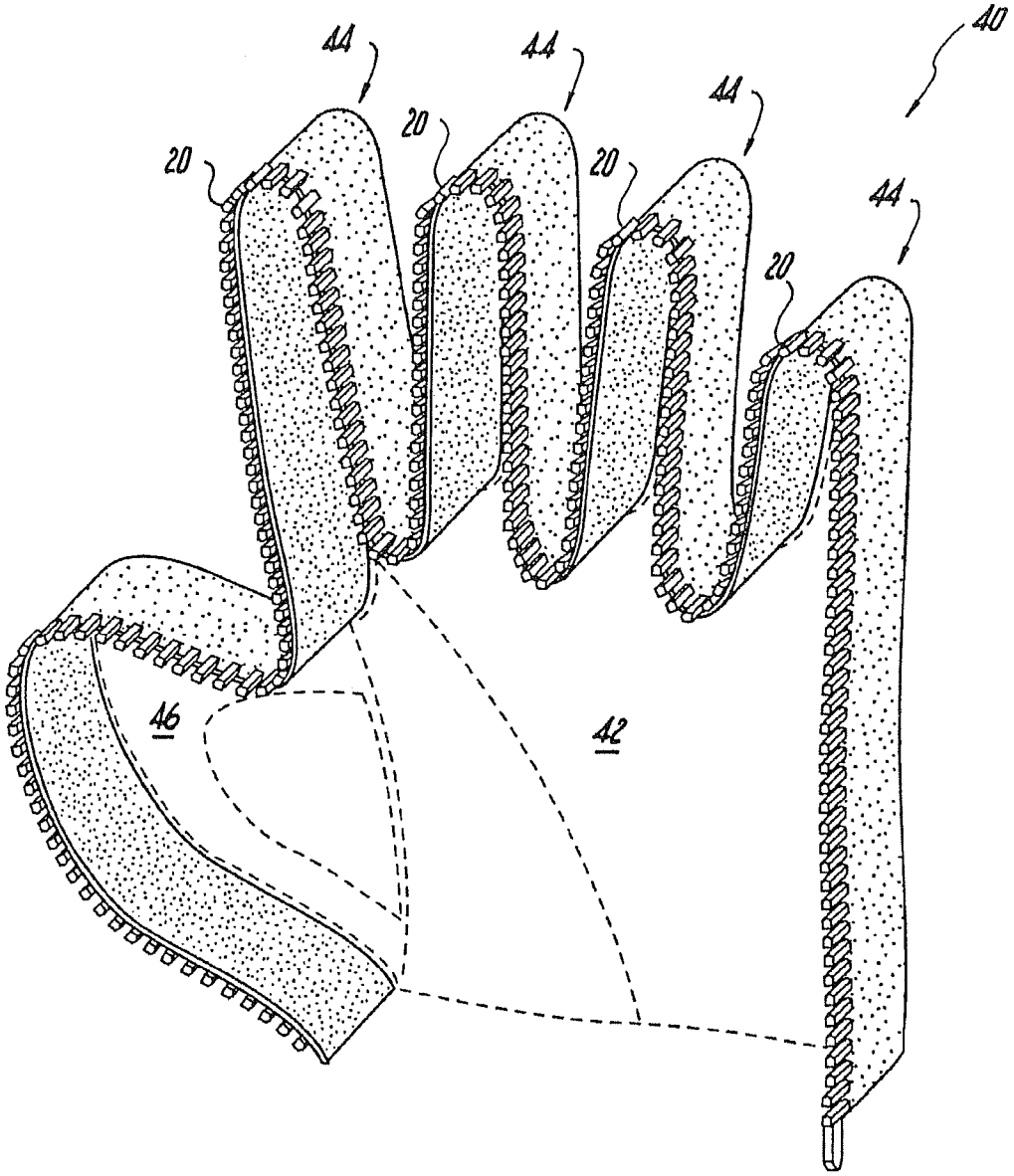
FIG. 6 is a rear perspective view thereof.

FIG. 6 is a rear perspective view of another embodiment for the zipper attached front palm portion 42 of a pair of front palm and back glove portions 40 and 12 respectively of sports glove 10 according to the present invention. This view shows how the zipper 20 goes from the side of the hand portion closest to the base of the unit continuously up toward and around each finger unit 44 and around the thumb member 46.

Figure 7:
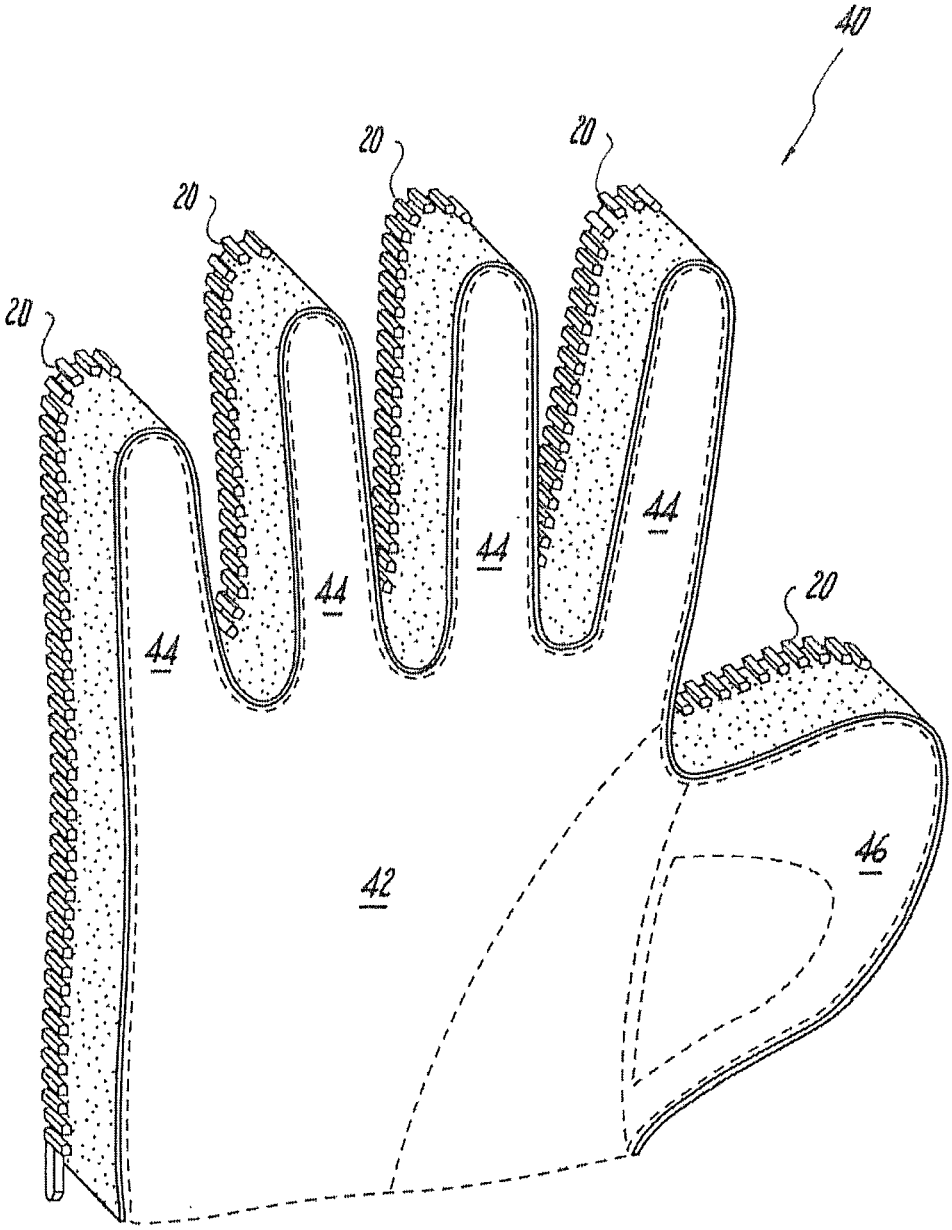
FIG. 7 is a front perspective view thereof.

FIG. 7 is a front perspective of a zipper attached front palm unit 42 according to the present invention. This view shows the majority of the zipper element 20 as it goes from the side of the hand closest to the cuff, around the plurality of finger elements 44 and around the thumb member 46 on the front palm unit 40.

Figure 8:
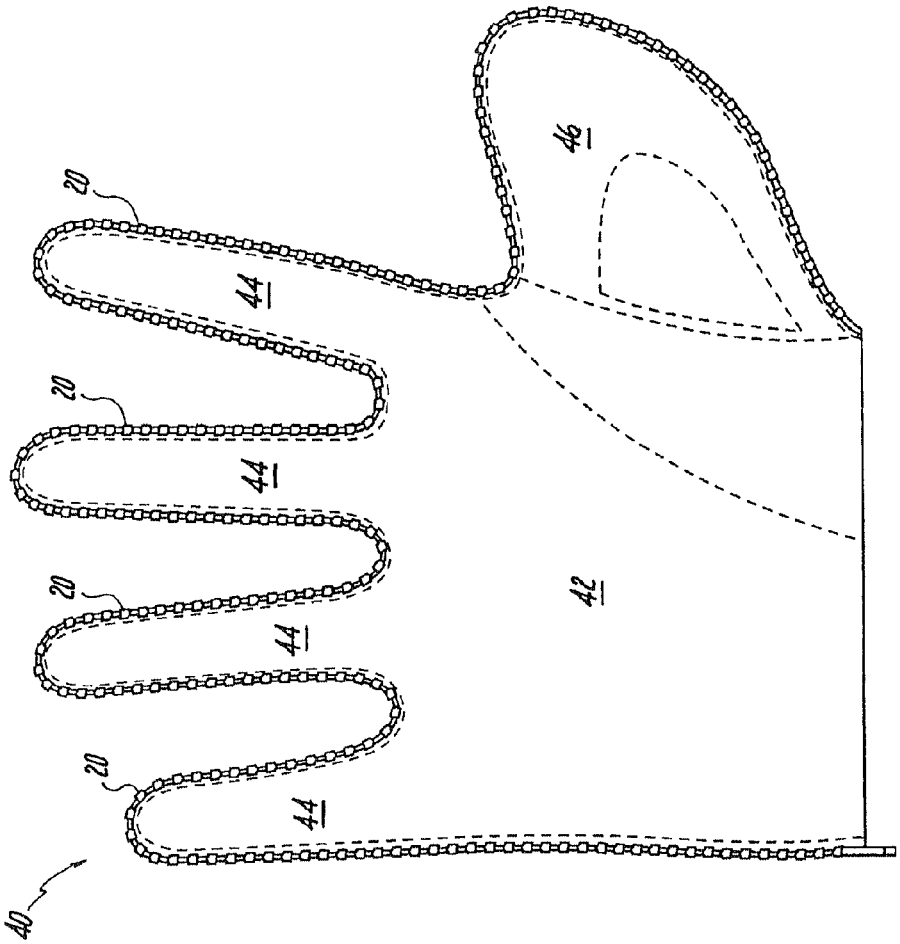
FIG. 8 is a rear elevational view thereof.

FIG. 8 is a rear elevational view of the front palm unit 42 of this invention. The zipper element 20 goes completely around the palm portion's periphery.

Figure 9:
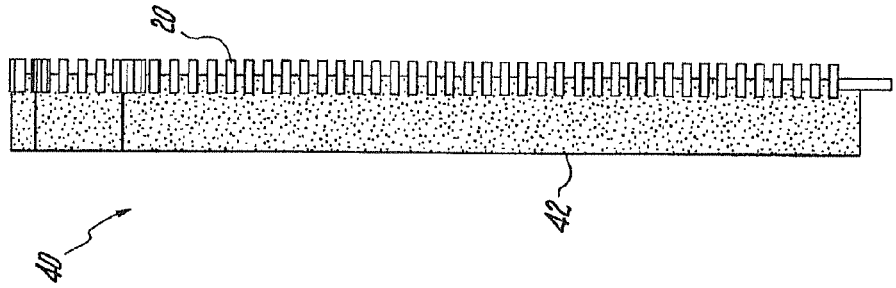
FIG. 9 is a right side elevational view of a zipper portion thereof.

FIG. 9 is a right side elevational view of the palm portion 42 and zipper portion 20. The length of the zipper 20 is determined by the palm size and dimensions. There is a material component and teeth component to the zipper attachment 20, which mates with rear zipper attachment 22 shown in FIG. 1. The material portion gets attached to the palm unit. Optionally the material portion to which the zipper is attached can be a strip of flexible and/or expandable elastic type stretchable material, to permit the palm portion 42 to have greater forward travel during closing or clenching of the hand of the user inside of glove 10. Optionally the strip can vary in width according to the amount of stretch required.

Figure 10:
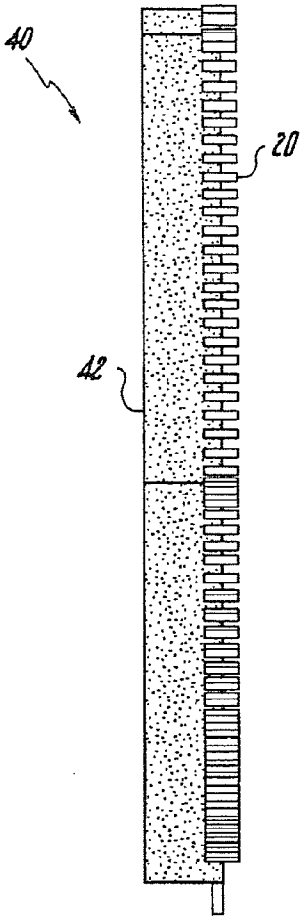
FIG. 10 is a left side elevational view thereof.

FIG. 10 is a left side elevational view of the palm portion 42 and zipper portion 20. The length of the zipper 20 is determined by the palm size and dimensions. There is a material component and teeth component to the zipper attachment 20. The material portion gets attached to the palm unit.

Figure 11:
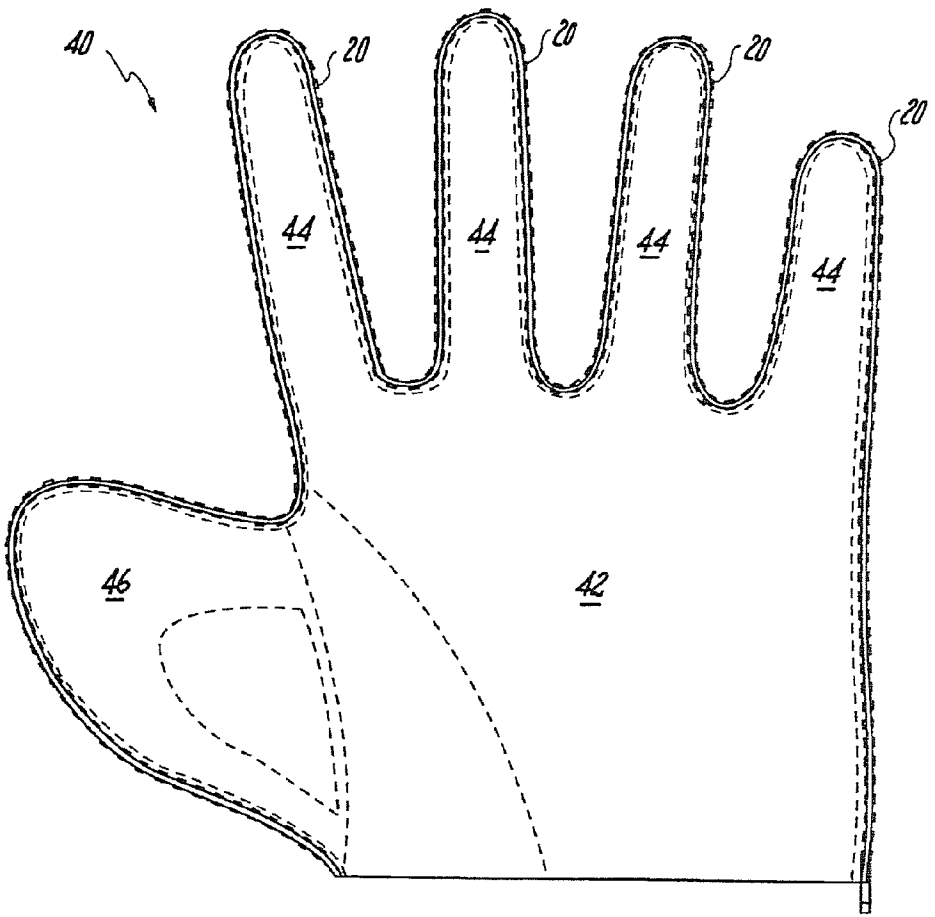
FIG. 11 is a rear elevational view of the other hand of the other embodiment in FIGS. 5-10 for one hand of a pair of zipper-attached front palm units according to the present invention.

FIG. 11 is a rear elevational view of the other hand of the front palm unit 42 of the pair of sports gloves 10, as in FIGS. 5-10 of this invention. The zipper element 20 goes completely around the palm portion 42's periphery.

The back glove unit 12 will have the matching portion of the zipper attachment 22, as shown in FIG. 1, so the palm unit 40 with palm portion 42 can be joined with the back glove unit 12 to form a hand receiving sports glove unit 10 according to the present invention.

Figure 12:
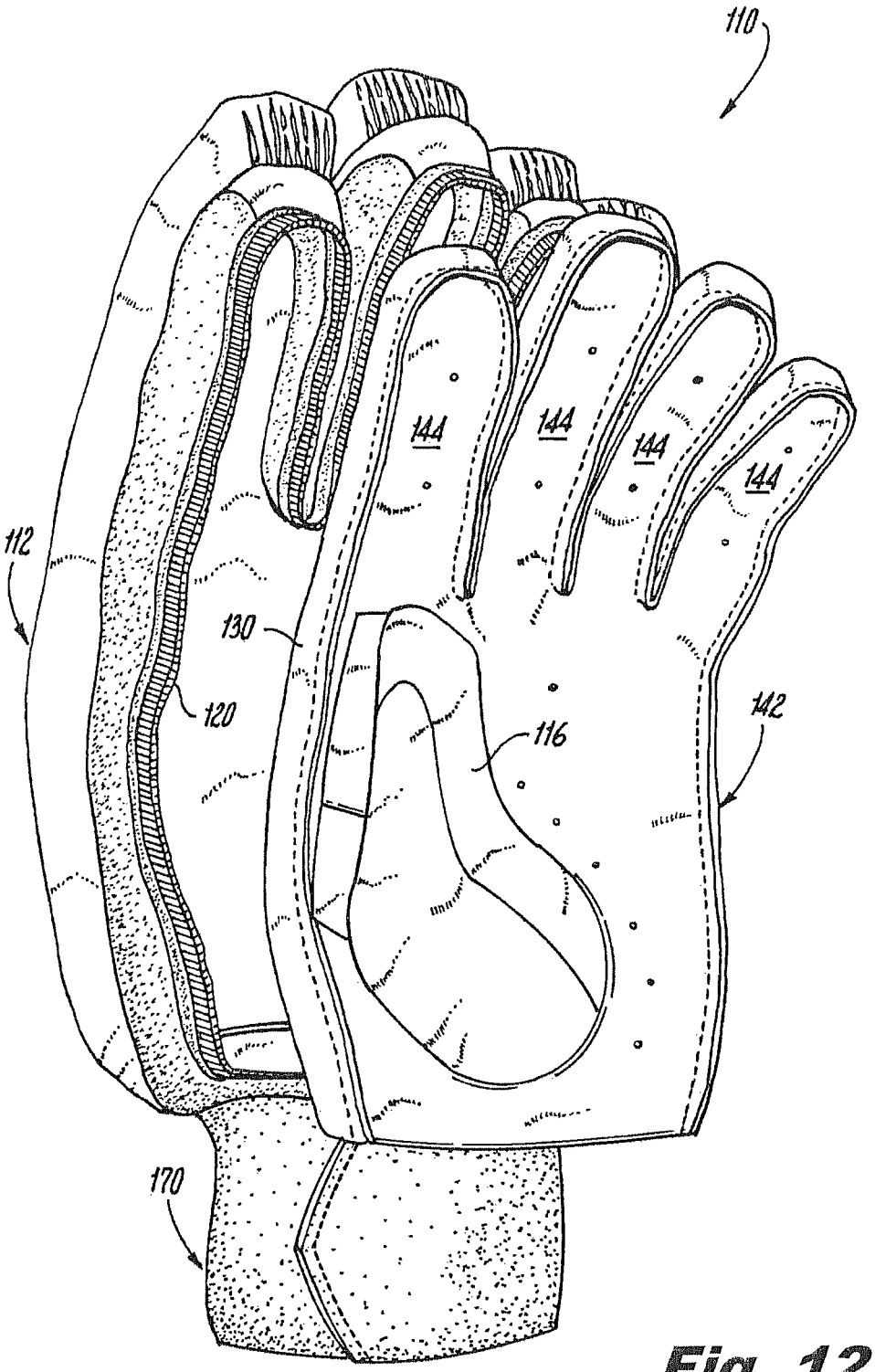
FIG. 12 is a perspective view of an alternate embodiment for a zipper attached sports glove, where the thumb stall protrudes from a surface of the palm portion of the sports glove, and is therefore not connected to a zipper or other connector.

FIG. 12 shows an alternate embodiment for a zipper attached sports glove, such as a cricket glove 110, where the thumb stall 116 protrudes from a surface of the palm portion 142 of the sports glove 110, and is therefore not connected to a zipper 120 or other connector. The zipper 120 connects the front palm portion 142 of the sports glove 110 with the rear portion 112 of the sports glove 110. The zipper 120 is covered by a fly cover 130 wherein the zipper 120 and the fly cover 130 extend in a continuous peripheral non-linear serpentine line of varying radii around each finger stall 144 and side of hand leading toward the cuff 170 on the glove portion and each finger stall and side of hand leading to the cuff on the front palm portion It is further noted that the fly cover 130 may extend front to rear as in FIG. 12 or the embodiment shown in FIG. 2, or from rear to front in an analogous situation as in the embodiment of FIG. 3, or overlapping both from front to back and back to front, as in the embodiment shown in FIG. 4.

Figure 13:
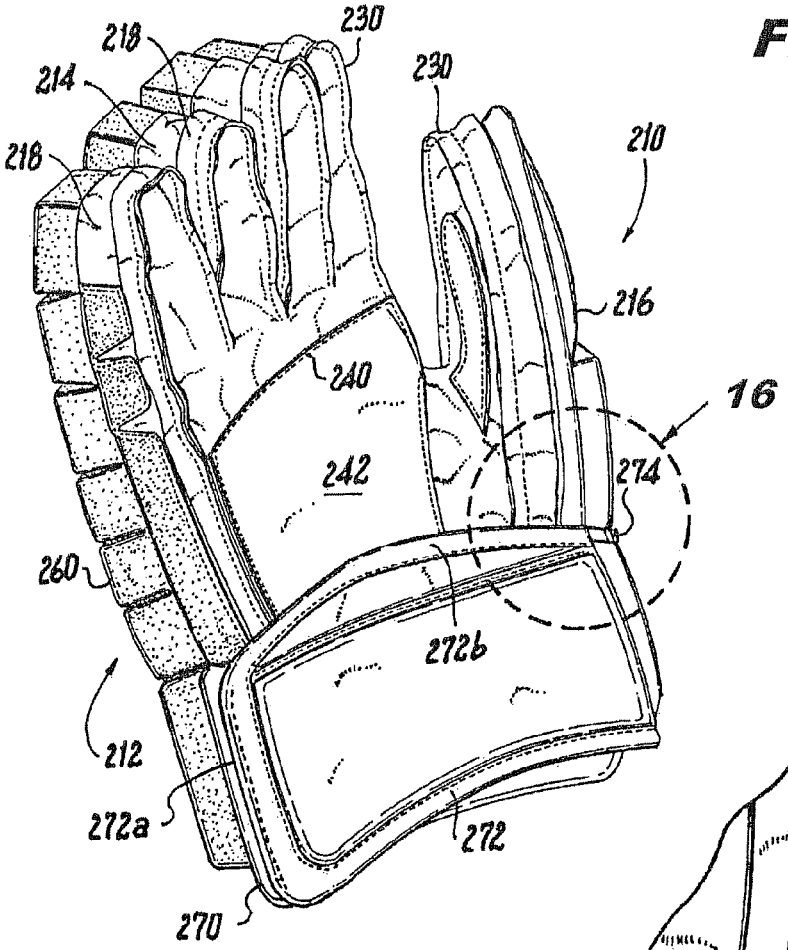
FIG. 13 a front perspective of another embodiment of the zipper attached sports glove with a fly cover protection, where the fly cover is pulled tight at its zipper attached end by a distal fastener strip extending from a pivotable/off flap.
Figure 15:
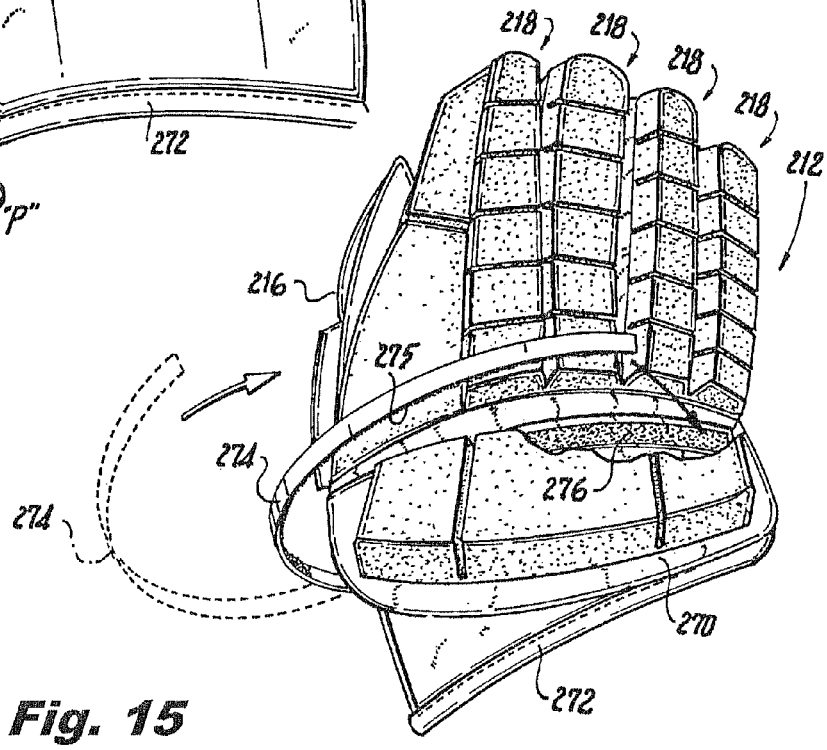
FIG. 15 is a rear perspective view showing the pivoting flap and fastener strip being wrapped around and being inserted into a top edge of the rear, partially fixed, flexible cuff of the hockey glove, for tightening against the glove and exerting pressure against the portion of the fly cover in the vicinity of the zipper pull tab, to facilitate the grasping and close covering of the fly cover over the zipper connecting the front and rear portions of the sport's glove together.

FIG. 13 shows in an alternate embodiment for a sports glove 210, having front palm portion 242 having periphery 240 above which extend finger stalls 218 and thumb portion 216, as well as connectable rear back portion 260 with finger stalls, each connected by a connector, such as zipper 220 having pull tab 220*a*. The zipper 220 is covered by fly cover 230, which grasps and closely covers zipper 220. Glove 210 also has front pivotable cuff portion 272, pivotable about edge 272*a*, as well as a distal end fastener strip 275 having a hook and loop type fastener 275, which is wrapped around partially fixed, flexible rear back cuff portion 270, which as shown in FIG. 15, is inserted into an open top edge of rear cuff 270 having a reciprocal hook and loop fastener 276 therein. wherein the back portion 260 and the front palm portion 242 are attached together by the zipper 220's two parts being respectively on the front palm portion 242 and the back portion 260, the zipper 220 being covered by the fly cover 230. The pivotable cuff 272 and fastener strip 274 exert pressure on the zipper tab handle 220*a* portion and the portion of the fly cover 230 thereat. to prevent exposure of the zipper to the skin of the players playing a game, such as hockey. and to facilitate the grasping and close covering of the fly cover over the zipper connecting the front and rear portions of the sport's glove together.

Figure 14:
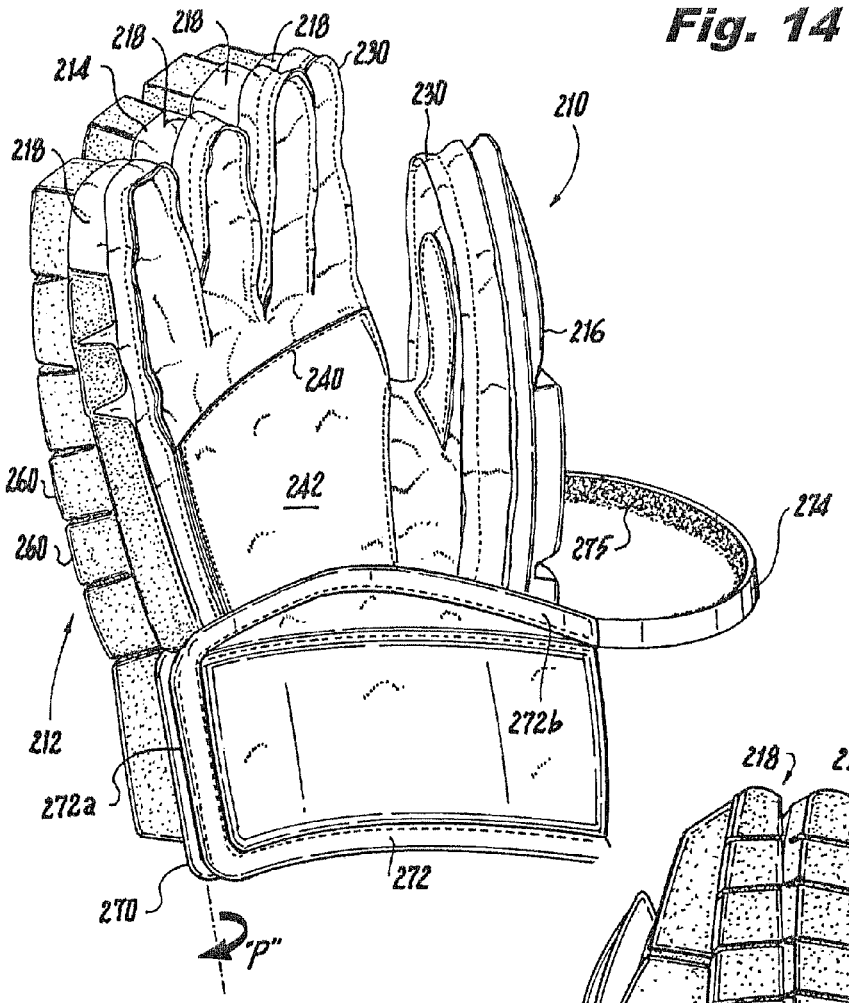
FIG. 14 is a front perspective view of the finger padded rear portion of the glove of FIG. 13, showing the distal fastener strip extended outward from a pivotable front cuff portion, which is pivotable in the directional arrow "p", when loosening and taking apart the glove.

FIG. 14 shows the pivoting cuff 272 and fastener strip 274 being wrapped around the rear cuff 270 and being inserted into an open top edge of the rear, partially fixed, flexible cuff 270 of the hockey glove 210, for tightening against the glove 210 and exerting pressure against the portion of the fly cover 230 in the vicinity of the zipper pull tab 220*a*, to further facilitate the grasping and close covering of the fly cover 230 over the zipper 220 connecting the front portion 242 and rear portion 260 of the sport's glove 210 together.

FIG. 15 shows finger padded rear portion 260 of the glove of FIG. 13, showing the distal fastener strip 274 with hook and loop portion 275 extended outward from pivotable front cuff portion 272, which is pivotable in the directional arrow "p" shown in FIG. 14, and attachable with hook and loop fastener strip 276 within rear partially fixed, flexible cuff portion 270.

Figure 16:
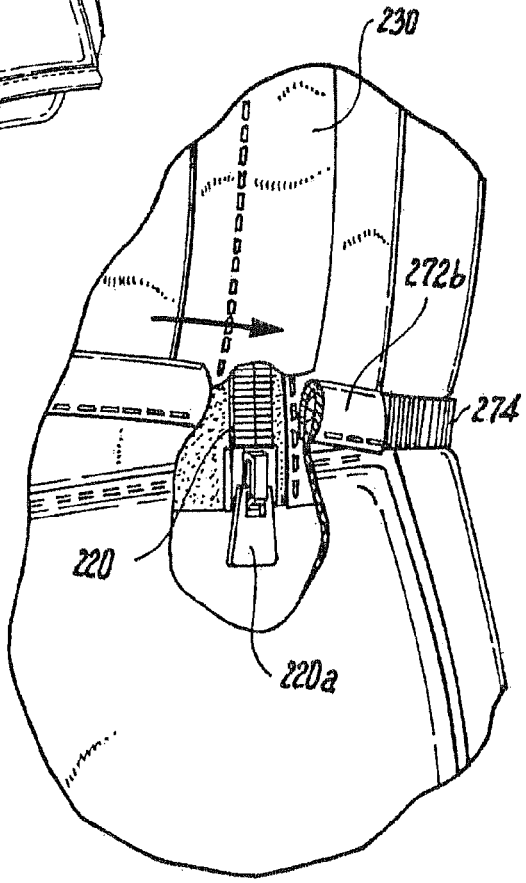
FIG. 16 is a close up detail view of the fly cover and zipper portion, shown in the circle view lines of FIG. 13, with the fastener strip pulled tight when the glove is worn to facilitate the grasping and close covering of the fly cover over the zipper connecting the front and rear portions of the sport's glove together.

FIG. 16 shows a close up view of a portion of the fly cover 260 and zipper portion, 220 shown in the circle view lines of FIG. 13, with the fastener strip 274 pulled tight when the glove 210 is worn, to facilitate the grasping and close covering of the fly cover 230 over the zipper 220 connecting the front portion 242 and rear portions 260 of the sport's glove together.

This long VELCRO® strip 274 that wraps around the back cuff 270 of the glove 210 secures the front cuff 272, and in so doing insures that the fly cover 230 is wrapped over the zipper tab 220 a located on the outside of the palm front portion 242, preventing any exposure of this metallic or other material zipper 220 against the skin of a sports game participant, either the participant wearing the glove 210, or another participant playing against the participant, as well as to any inadvertent contact with an official referee or spectator at the sport's game.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A method of protecting the exposed face, neck and hand skin of a contact sports game contact sports game participant user, participant player, players, referee, official, coach or spectator when exposed to a violent contact by exposed zippers on a glove of the contact sports game participant user, participant player, players, referee, official, coach or spectator, during a contact sports game, the glove having a separate joinable front palm portion and a separate back joinable glove portion joinably attachable to said front palm portion by a zipper; wherein when said respective front palm portion and said separate back joinable glove portion are joined, said respective front palm portion and separate back joinable glove portion form respective finger stalls for insertion of fingers therein;

the method comprising the steps of:

said front palm portion covered by a pivotable cuff portion and said rear back joinable portion having a partially fixed, flexible cuff portion having an open top edge with a distal fastener strip of said pivotable front cuff portion insertable in said open top edge thereof;

providing a protective glove with at least one fly cover covering said zipper;

extending said at least one fly cover in a continuous peripheral non-linear serpentine line of varying radii over said zipper around each finger stall and side of hand leading toward the cuff on the glove portion and each finger stall and side of hand leading to the cuff on said front palm portion; wherein said at least one fly cover grasps over and closely covers said zipper by friction;

providing a physical barrier overlaying the outer surface of the zipper with said fly cover and preventing violent physical contact of said zipper to the exposed face, neck or hand skin of the contact sports game contact sports game participant user, participant player, players, referee, official, coach or spectator; and, tightening said pivotable front cuff portion against said fly cover with a distal fastener strip closely grabbing around said front and rear cuff portion over a beginning of said fly cover near a zipper clasp of said zipper, wherein said distal fastener strip extends around said rear partially fixed, flexible cuff portion into a top edge thereof between said rear cuff portion and said rear of said glove, thereby pulling against and exerting force against said fly cover, making said fly cover grasp and closely cover over said zipper along its length thereof.

2. The method as in claim 1 wherein said respective finger stalls comprise upper finger stalls for the upper fingers of the hand of the participant user.

3. The method as in claim 1 wherein said respective finger stalls further comprise a thumb stall for the thumb of the band of the participant user.

4. The method as in claim 3 wherein a material portion to which said zipper is attached comprises a strip of flexible and/or expandable elastic type stretchable material, to permit said front palm portion to have greater forward travel during closing or clenching of the hand of the participant user inside of said glove.

5. The method as in claim 3 further comprising the step of providing a plurality of fly covers over said zipper and overlapping each other from front to back and from back to front between said separate joinable front palm portion and said separate joinable back glove portion of the glove.

6. The method as in claim 1 wherein said fly cover further extends over a thumb portion of said glove.

7. A sports glove, used in a sports event by a sport participant holding an item during game play, comprising:

a front palm portion having finger stalls adapted for insertion of fingers therein;

a back joinable glove portion attachable to said front palm portion by a zipper, in a closed position during use of the glove during game play; and said zipper continuously covered by a fly cover clasping and extending closely over said zipper by friction during use of the glove during game play;

wherein said closed zipper and said fly cover extend in a continuous peripheral non-linear serpentine line of varying radii around each finger stall and thumb stall and side of hand leading toward the cuff on the glove portion and each finger stall and thumb stall and side of hand leading to said cuff on said front palm portion;

said front palm portion covered by a pivotable cuff portion and said rear back joinable portion having a partially fixed, flexible cuff portion having an open top edge with a fastener strip therein;

said front cuff portion being tightened against said fly cover with a distal fastener strip closely grabbing around said front and rear cuff portion over a beginning of said fly cover near a zipper clasp of said zipper, wherein said fastener strip extends into a top edge between said rear cuff portion and said rear of said glove;

thereby pulling against and exerting force against said fly cover, making said fly cover grasp and closely cover over said zipper along its length thereof.

8. The sports glove as in claim 7 wherein a connection end of said fly back to front cover is attached to said rear back joinable portion of said sports glove.

9. The sports glove as in claim 7 wherein a connection end of said fly front to said rear back joinable cover is attached to said front palm portion of said sports glove.

10. The sports glove as in claim 7 wherein a connection end of said fly back to front cover is attached to a side portion of said sports glove between said rear back joinable portion and said front palm portion of said sports glove.

11. The sports glove as in claim 7 wherein said zipper connector has teeth spaced from a back side of said front palm portion.

12. The sports glove as in claim 7 wherein said zipper connector is attached toward a middle of said fingers of said sports glove.

13. The sports glove as in claim 7 wherein said zipper connector is attached toward a back of said fingers of said sports glove.

14. The sports glove as in claim 7 wherein said zipper connector is attached toward a front of said fingers of said sports glove.

15. The sports glove as in claim 7 further comprising a plurality of padding members internally encapsulated within said sports glove.

16. The sports glove as in claim 7 wherein said rear back joinable portion and said front palm portion are attached together by said zipper being on said front palm portion and said rear back joinable portion, said zipper being covered by said fly cover.

17. The sports glove as in claim 7 wherein said rear back joinable portion and said front palm portion are attached together by said zipper being on said front palm portion and said rear back joinable portion, said zipper being covered by a combination of front to back and back to front fly covers clasping and extending closely over said zipper.

18. The sports glove as in claim 7 wherein said zipper and said fly cover extend along the thumb on said sports glove portion and on the front palm portion and fingers of said front palm portion, thereby connecting said front palm portion to said rear back joinable portion forming a hand receiving unit.

19. The sports glove as in claim 7 wherein a combination of front to back and back to front fly covers, each clasping and extending closely over said zipper, overlap each other.

20. The sports glove as in claim 7 wherein said fly cover further extends over a thumb portion of said glove.

21. The sports glove as in claim 19 wherein said zipper extends over a thumb portion, and said fly cover extends over said zipper extending over said thumb.

22. The sports glove as in claim 7 further comprising said fly cover having a thin peripheral edge of a friction attachment fastener joinable to a reciprocal friction attachment fastener located on the glove surface immediately adjacent to said zipper, wherein said friction attachment fastener overlays and extends beyond the zipper.

23. A sports glove, used in a sports event by a sport participant holding an item during game play, comprising:

a front palm portion having finger stalls adapted for insertion of fingers therein;

a back joinable glove portion attachable to said front palm portion by a zipper, in a closed position during use of the glove during game play;

said front palm portion covered by a pivotable cuff portion and said rear back joinable portion having a partially fixed, flexible cuff portion having an open top edge with a fastener strip therein;

said front cuff portion being tightened against said rear cuff portion with a distal fastener strip extending from said pivotable cuff portion and closely grabbing around said front and rear cuff portion.

24. The sports glove as in claim 23 wherein said fastener strip extends into a top edge between said rear cuff portion and said rear of said glove.

* * * * *